US010427441B2

(12) United States Patent
Yoda et al.

(10) Patent No.: US 10,427,441 B2
(45) Date of Patent: Oct. 1, 2019

(54) THERMAL TRANSFER SHEET

(71) Applicant: Dai Nippon Printing Co., Ltd., Tokyo (JP)

(72) Inventors: Shinya Yoda, Tokyo (JP); Emi Matsuba, Tokyo (JP)

(73) Assignee: Dai Nippon Printing Co., Ltd., Shinjuku-Ku, (JP)

( * ) Notice: Subject to any disclaimer, the term of this patent is extended or adjusted under 35 U.S.C. 154(b) by 0 days.

(21) Appl. No.: 15/558,328

(22) PCT Filed: Mar. 18, 2016

(86) PCT No.: PCT/JP2016/058709
§ 371 (c)(1),
(2) Date: Sep. 14, 2017

(87) PCT Pub. No.: WO2016/158497
PCT Pub. Date: Oct. 6, 2016

(65) Prior Publication Data

US 2018/0065393 A1 Mar. 8, 2018

(30) Foreign Application Priority Data

Mar. 31, 2015 (JP) ..... 2015-074514

(51) Int. Cl.
*B41M 5/382* (2006.01)
*B41M 5/41* (2006.01)
(Continued)

(52) U.S. Cl.
CPC ..... *B41M 5/38207* (2013.01); *B41M 5/41* (2013.01); *B41M 5/42* (2013.01);
(Continued)

(58) Field of Classification Search
CPC .... B41M 3/382; B41M 3/38207; B41M 5/40; B41M 5/41; B41M 5/42; B41M 2205/38
(Continued)

(56) References Cited

U.S. PATENT DOCUMENTS 5,774,164 A 6/1998 Yamazaki et al.
7,517,833 B2 * 4/2009 Fukui et al. ..... B41M 5/035 503/227

(Continued)

FOREIGN PATENT DOCUMENTS

JP 08-118823 A1 5/1996
JP 08-310144 A1 11/1996

(Continued)

OTHER PUBLICATIONS

International Search Report and Written Opinion (Application No. PCT/JP2016/058709) dated May 31, 2016.

(Continued)

*Primary Examiner* — Gerard Higgins
(74) *Attorney, Agent, or Firm* — Burr & Brown, PLLC

(57) ABSTRACT

A thermal transfer sheet including a primer layer and a peel-off layer provided in this order on a substrate. The primer layer is allowed to contain at least one of: (1) inorganic particles derived from sol-based inorganic particles having a primary particle size of 200 nm or less, (2) scale-like inorganic particles, (3) a polyvinyl pyrrolidone type resin having a glass-transition temperature (Tg) of 60° C. or more, (4) a polyester type resin having a glass-transition temperature (Tg) of 60° C. or more, (5) a polyurethane type resin having a thermal melting temperature of 100° C. or more, (6) a resin formed by curing a thermoplastic resin having a glass-transition temperature (Tg) of 40° C. or more, and (7) a resin formed by curing a polyvinyl alcohol type resin.

1 Claim, 2 Drawing Sheets

(51) Int. Cl.

| | |
|---|---|
| ***B41M 5/42*** | (2006.01) |
| ***B41M 5/44*** | (2006.01) |
| *B41M 5/40* | (2006.01) |

(52) U.S. Cl.
CPC ..... *B41M 5/426* (2013.01); *B41M 5/44* (2013.01); *B41M 5/40* (2013.01); *B41M 2205/06* (2013.01); *B41M 2205/30* (2013.01); *B41M 2205/38* (2013.01)

(58) Field of Classification Search
USPC ..... 503/227
See application file for complete search history.

(56) References Cited

U.S. PATENT DOCUMENTS

| | | | |
|---|---|---|---|
| 2003/0174197 | A1 | 9/2003 | Odaka et al. |
| 2013/0135417 | A1 | 5/2013 | Suzuki et al. |
| 2015/0239273 | A1 | 8/2015 | Sakamoto et al. |
| 2016/0039237 | A1 | 2/2016 | Yoshida et al. |

FOREIGN PATENT DOCUMENTS

| | | | |
|---|---|---|---|
| JP | 2001-315443 | A1 | 11/2001 |
| JP | 2003-326865 | A1 | 11/2003 |
| JP | 2005-035122 | A1 | 2/2005 |
| JP | 2009-061684 | A1 | 3/2009 |
| JP | 2009-090521 | A1 | 4/2009 |
| JP | 2010-076331 | A1 | 4/2010 |
| JP | 2010-076332 | A1 | 4/2010 |
| JP | 2011-104971 | A1 | 6/2011 |
| JP | 2012-035506 | A1 | 2/2012 |
| JP | 2012-171282 | A1 | 9/2012 |
| JP | 2012-210721 | A1 | 11/2012 |
| JP | 2013-202842 | A1 | 10/2013 |
| JP | 2014-065246 | A1 | 4/2014 |
| JP | 2014-080016 | A1 | 5/2014 |
| JP | 2014-151615 | A1 | 8/2014 |
| JP | 2015-051539 | A1 | 3/2015 |

OTHER PUBLICATIONS

Extended European Search Report (Application No. 16 772 379.0) dated Jan. 8, 2019.

* cited by examiner

THERMAL TRANSFER SHEET

TECHNICAL FIELD

The present invention relates to a thermal transfer sheet having a peel-off layer.

BACKGROUND ART

As a device for forming a print on a transfer receiving article without being restricted, as proposed in Patent Literature 1, an intermediate transfer medium in which a transfer layer including a receiving layer (hereinbelow, this layer may be referred to as a transfer layer) is peelably provided on a substrate has been used. According to this intermediate transfer medium, a print where a thermally transferable image has been formed on an optional transfer receiving article can be obtained by forming the thermally transferable image on the receiving layer of the intermediate transfer medium by means of a thermal transfer sheet having a colorant layer, and then transferring the transfer layer which includes this receiving layer onto the optional transfer receiving article. Particularly, an intermediate transfer medium is particularly preferably used for transfer receiving articles onto which colorants are less likely to transfer and thus which cannot form a high-quality image directly thereon, transfer receiving articles which easily fuse with a colorant layer on thermal transfer, and the like.

Incidentally, depending on the type of a print obtained by transferring the transfer layer of the intermediate transfer medium on a transfer receiving article, it may be necessary to leave a certain region untreated, for instance, regions allocated for an IC chip, a magnetic strip, a transmitting and receiving antenna unit, a signature portion and the like. Thus, on the surface of the transfer receiving article, in some cases, there is a region that is inconvenient when covered with the transfer layer. In other words, there may be some cases where the surface of a transfer receiving article is required to be exposed.

Under these circumstances, some attempts have been made, wherein, by using a thermal transfer sheet in which a peel-off layer is provided on one surface of a substrate, in advance of transferring the transfer layer of an intermediate transfer medium onto a transfer receiving article, a portion of the transfer layer, for example, a region of the transfer layer which is not desired to be transferred onto the transfer receiving article is removed (it may be also referred to as "peeled off") by means of the peel-off layer in advance. For example, Patent Literature 2 proposes a method in which, after the peel-off layer of a thermal transfer sheet and the transfer layer of an intermediate transfer medium are superposed on each other so as to become in contact with each other, energy is applied to the other surface of the substrate of the heat transfer sheet, and the transfer layer corresponding to the region to which the energy has been applied is removed by means of the peel-off layer.

As one of problems that may occur when a portion of the transfer layer of the intermediate transfer medium is removed by means of the peel-off layer of the above-described thermal transfer sheet, a problem that the peel-off layer, which naturally should remain together with the transfer layer that has been removed on the side of the thermal transfer sheet, transfers to the side of the intermediate transfer medium (so called reverse transfer of the peel-off layer) can be included. Reverse transfer of the peel-off layer tends to occur in the case where adhesiveness between the substrate and the peel-off layer (it may be also referred to as an adhesive property) is low. Under these circumstances, for example, in Patent Literature 2 described above, an embodiment in which the adhesiveness between the substrate and the peel-off layer has been improved by using a substrate subjected to easily-adhesive treatment is proposed although no attention is paid to reverse transfer of the peel-off layer.

However, responding to a recent demand for accelerating printers, the energy to be applied to the thermal transfer sheet tends to increase when the transfer layer of an intermediate transfer medium is removed by means of a peel-off layer. In the case where, as the transfer layer of the intermediate transfer medium, a layer having high durability, for example, a thick transfer layer is used, the transfer layer becomes difficult to remove unless the energy to be applied to the thermal transfer sheet is increased. As for thermal transfer sheets having a peel-off layer proposed up to now, the measure in the case where the energy to be applied to the thermal transfer sheet is increased on removal of a portion of the transfer layer is not sufficient. Under the current circumstances, reverse transfer of the peel-off layer cannot be sufficiently inhibited when high energy is applied to the thermal transfer sheet to remove a portion of the transfer layer of the intermediate transfer medium.

CITATION LIST

Patent Literature

Patent Literature 1: Japanese Patent Laid-Open No. 2014-80016

Patent Literature 2: Japanese Patent Laid-Open No. 2003-326865

SUMMARY OF INVENTION

Technical Problem

The present invention has been made in view of the above-mentioned circumstances, and the present invention aims principally to provide a thermal transfer sheet by means of which a transfer layer can be accurately removed without being influenced by the conditions under which the transfer layer of an intermediate transfer medium is removed by means of a peel-off layer.

Solution to Problem

The present invention for solving the above problems is a thermal transfer sheet having a peel-off layer, characterized in that a primer layer and a peel-off layer are provided in this order on a substrate and that the primer layer contains at least one of (1) inorganic particles derived from sol-based inorganic particles having a primary particle size of 200 nm or less, (2) scale-like inorganic particles, (3) a polyvinyl pyrrolidone type resin having a glass-transition temperature (Tg) of 60° C. or more, (4)a polyester type resin having a glass-transition temperature (Tg) of 60° C. or more, (5)a polyurethane type resin having a thermal melting temperature of 100° C. or more, (6) a thermoplastic resin having a glass-transition temperature (Tg) of 40° C. or more, and (7) a resin formed by curing a polyvinyl alcohol type resin.

Additionally, the sol-based inorganic particles having a primary particle size of 200 nm or less may be alumina sol or silica sol, and the scale-like inorganic particles may be scale-like silica.

Advantageous Effects of Invention

According to the thermal transfer sheet of the present invention, the transfer layer can be accurately removed without being influenced by the conditions under which the transfer layer of the intermediate transfer medium is removed by means of the peel-off layer.

DESCRIPTION OF EMBODIMENTS

<<Thermal Transfer Sheet>>

Figure 1:
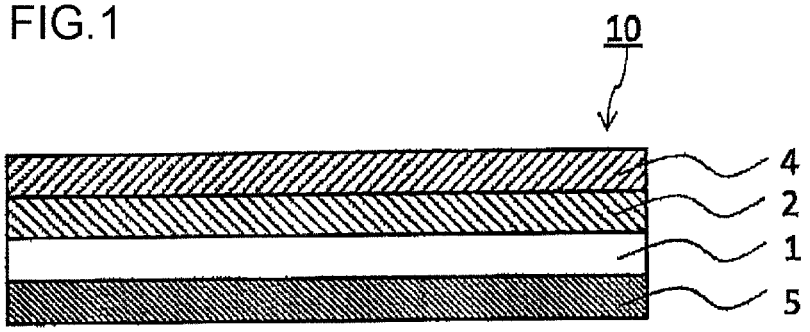
FIG. 1 is a schematic sectional view of a thermal transfer sheet of one embodiment.

The thermal transfer sheet 10 of one embodiment of the present invention (hereinbelow, the sheet is referred to as the thermal transfer sheet of one embodiment) has a structure in which a primer layer 2 and a peel-off layer 4 are provided in this order on one surface of a substrate 1, as shown in FIG. 1. An optional back face layer 5 is also provided on the other surface of the substrate 1. The substrate 1, the primer layer 2, and the peel-off layer 4 are essential constituents in the thermal transfer sheet 10 of one embodiment.

Figure 2:
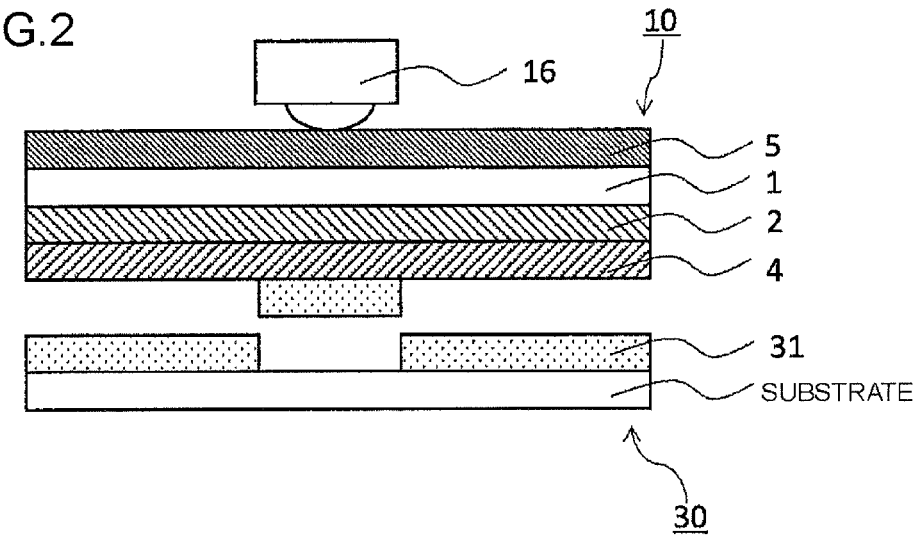
FIG. 2 is a schematic sectional view showing a state in which the thermal transfer sheet of one embodiment is combined with an intermediate transfer medium and energy is applied to the combination.

The thermal transfer sheet 10 of one embodiment is a thermal transfer sheet to be used for removing a portion of the transfer layer of the intermediate transfer medium. Specifically, as shown in FIG. 2, the peel-off layer 4 of the thermal transfer sheet 10 and the transfer layer 31 of the intermediate transfer medium 30 are superposed on each other, and energy is applied to the back face side of the thermal transfer sheet 10 by means of a heating device 16 such as a thermal head. The thermal transfer sheet 10 is used for removing the transfer layer 31 of the intermediate transfer medium 30 located at a position corresponding to the region to which energy has been applied. Hereinbelow, the case where the subject to be removed by means of the peel-off layer 4 of the thermal transfer sheet 10 of one embodiment is the transfer layer of the intermediate transfer medium will be described as an example. Also hereinbelow, an index indicating whether the transfer layer 31 of the intermediate transfer medium 30 can be accurately removed by means of the thermal transfer sheet 10 having the peel-off layer 4 is referred to as "peel-off property". In other words, that the peel-off property is satisfactory means that the transfer layer 31 can be removed as intended by means of the peel-off layer 4. It should be noted that the thermal transfer sheet referred to herein is a collective term for media applied to a heating device such as a thermal head. The thermal transfer sheet is used to remove a portion of the transfer layer of the intermediate transfer medium by applying a heating device as in the present invention. Those having a structure in which the primer layer 2 and the peel-off layer 4 are provided in this order on one surface of the substrate are also included in the thermal transfer sheet.

(Substrate)

There is no limitation with respected to the substrate 1 constituting the thermal transfer sheet 10 of one embodiment, and conventionally-known substrates in the field of thermal transfer sheets can be appropriately selected and used. Examples include tissue papers, such as glassine paper, capacitor paper, and paraffin paper; and stretched or unstretched films of plastics, such as polyesters having high heat resistance such as polyethylene terephthalate, polyethylene naphthalate, polybutylene terephthalate, polyphenylene sulfide, polyether ketone, or polyether sulfone; polypropylenes, polycarbonate, cellulose acetates, polyethylene derivatives, polyvinyl chloride, polyvinylidene chloride, polystyrenes, polyamides, polyimides, polymethylpentene, or ionomers. Composite films obtained by laminating two or more of these materials can be also used.

There is no particular limitation with respect to the thickness of the substrate 1, and the thickness is preferably in the range of 2 μm or more 10 μm or less.

(Primer Layer)

Figure 3:
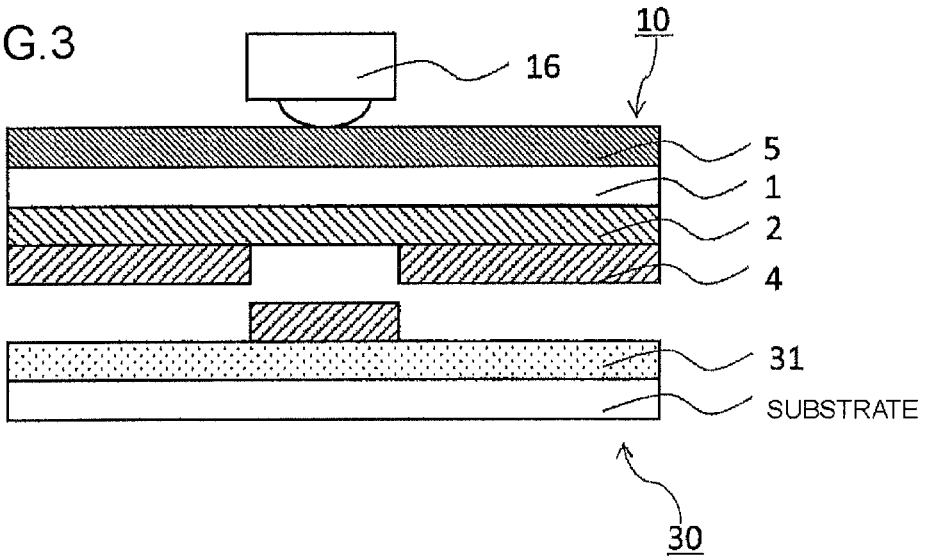
FIG. 3 is a schematic sectional view showing a state in which a comparative thermal transfer sheet is combined with an intermediate transfer medium and energy is applied to the combination.

In order to make the peel-off property of the thermal transfer sheet having a peel-off layer satisfactory, it is important to inhibit occurrence of "reverse transfer" of the peel-off layer when the transfer layer of the intermediate transfer medium is removed. "Reverse transfer" of the peel-off layer refers to a phenomenon where, when the peel-off layer 4 of the thermal transfer sheet 10 and the transfer layer 31 of the intermediate transfer medium 30 are superposed on each other and energy is applied to the back face side of the thermal transfer sheet 10 by means of a heating device 16 such as a thermal head to remove the transfer layer 31 of the intermediate transfer medium 30 located at a position corresponding to the region to which energy has been applied, the peel-off layer 4, which naturally should remain on the side of the thermal transfer sheet 10 together with the transfer layer 31 that has been removed, transfers to the side of the intermediate transfer medium 30, as shown in FIG. 3. Incidentally, FIG. 3 is a schematic sectional view showing a state in which a comparative thermal transfer sheet not satisfying the matters specifying the invention of the thermal transfer sheet of one embodiment is combined with the intermediate transfer medium and energy is applied to the combination.

Occurrence of "reverse transfer" of the peel-off layer is closely associated with the interlayer adhesiveness between the substrate and the peel-off layer (between another layer and the peel-off layer in the case where another layer is provided between the substrate and the peel-off layer). With lower interlayer adhesiveness between the substrate and the peel-off layer, "reverse transfer" of the peel-off layer tends to occur. As a measure to increase the interlayer adhesiveness between the substrate and the peel-off layer, measures to provide surface treatment on the surface of the substrate on the side that is brought into contact with the peel-off layer are known, for example, measures to provide easily-adhesive treatment or corona treatment. However, with such measures, when high energy is applied to the back face side of the thermal transfer sheet in order to accelerate printers or remove a highly-durable transfer layer, the interlayer adhesiveness between the substrate and the peel-off layer becomes reduced, and the peel-off layer becomes easily peeled from the substrate.

A measure to provide a primer layer for improving the interlayer adhesiveness between the substrate and the peel-off layer between the substrate and the peel-off layer, and the like are also included. However, in the case of using a primer layer that has been proposed so far, the interlayer adhesiveness between the substrate and the peel-off layer when high energy is applied to the thermal transfer sheet has not been sufficiently satisfied under the current circumstances.

The thermal transfer sheet 10 of one embodiment for which such a point is considered is characterized in that, as shown in FIG. 1, the primer layer 2 to be provided between the substrate 1 and the peel-off layer 4 described later is a primer layer that contains at least one of: (1) inorganic particles derived from sol-based inorganic particles having a primary particle size of 200 nm or less, (2) scale-like inorganic particles, (3) a polyvinyl pyrrolidone type resin having a glass-transition temperature (Tg) of 60° C. or more, (4) a polyester type resin having a glass-transition temperature (Tg) of 60° C. or more, (5) a polyurethane type resin having a thermal melting temperature of 100° C. or more, (6) a resin formed by curing a thermoplastic resin having a glass-transition temperature (Tg) of 40° C. or more, and (7) a resin formed by curing a polyvinyl alcohol type resin.

According to the thermal transfer sheet 10 of one embodiment having the primer layer 2 of this characteristic, even in the case where the energy to be applied to the back face side of the thermal transfer sheet 10 is increased when the transfer layer 31 of the intermediate transfer medium 30 is removed, the adhesiveness between the substrate 1 and the peel-off layer 4 can be maintained in a high state by the action of the primer layer 2 of the characteristic described above, and as a result, occurrence of "reverse transfer" in the peel-off layer 4 can be inhibited. In other words, irrespective of the conditions under which the transfer layer 31 is removed, the transfer layer 31 of the intermediate transfer medium 30 can be accurately removed by means of the peel-off layer 4.

The primer layer 2 of the characteristic described above is roughly classified into the following forms.

(First form): a form of a primer layer containing inorganic particles derived from sol-based inorganic particles having a primary particle size of 200 nm or less (Second form): a form of a primer layer containing scale-like inorganic particles (Third form): a form of a primer layer containing a polyvinyl pyrrolidone type resin having a glass-transition temperature (Tg) of 60° C. or more (Fourth form): a form of a primer layer containing a polyester type resin having a glass-transition temperature (Tg) of 60° C. or more (Fifth form): a form of a primer layer containing a polyurethane type resin having a thermal melting temperature of 100° C. or more (Sixth form): a form of a primer layer containing a resin formed by curing a thermoplastic resin having a glass-transition temperature (Tg) of 40° C. or more (Seventh form): a form of a primer layer containing a resin formed by curing a polyvinyl alcohol type resin (Eighth form): a form of a primer layer in which two or more of the above-described (First form) to (Seventh form) are combined Hereinbelow, each of the forms will be described.

<Primer Layer of First Form>

The primer layer 2 of First form contains inorganic particles derived from sol-based inorganic particles having a primary particle size of 200 nm or less. In other words, the primer layer formed by using sol-based inorganic particles having a primary particle size of 200 nm or less is provided between the substrate 1 and the peel-off layer 4. By providing the primer layer 2 of First form containing inorganic particles derived from sol-based inorganic particles having a primary particle size of 200 nm or less between the substrate 1 and the peel-off layer 4, the adhesiveness between the substrate 1 and the peel-off layer 4 can be increased. Thus, according to the primer layer 2 of First form, even in the case where the energy to be applied to the thermal transfer sheet is increased when the transfer layer of the intermediate transfer medium is removed, occurrence of "reverse transfer" in the peel-off layer 4 can be inhibited. In other words, even in the case where the energy to be applied to the thermal transfer sheet is increased when the transfer layer of the intermediate transfer medium is removed, the transfer layer of the intermediate transfer medium can be accurately removed.

The mechanism by which the adhesiveness between the substrate 1 and the peel-off layer 4 is improved by providing the primer layer 2 of First form between the substrate 1 and the peel-off layer 4 has not been necessarily clarified so far. However, the primer layer 2 having good film-formability can be formed by using sol-based inorganic particles having a primary particle size of 200 nm or less, and it is presumed that this film-formability contributes to the improvement in the adhesiveness between the substrate 1 and the peel-off layer 4. Also according to the sol-based inorganic particles having primary particle size of 200 nm or less, the sol-based inorganic particles are aggregated and bonded in an orientated manner in the formation phase of the primer layer 2. According to this, it is presumed that the interlayer adhesiveness between the substrate 1 and the primer layer 2 of First form has been improved. Additionally, the surface of the primer layer 2 formed by using the sol-based inorganic particles has fine asperities. It is presumed that these fine asperities serve to improve the interlayer adhesiveness between the primer layer 2 of First form and the peel-off layer 4. Furthermore, the inorganic particles have a property of preventing their thermophysical properties from changing by heat applied to the thermal transfer sheet on peeling-off, and thus, the inorganic particles will not be a cause of reduction in the adhesiveness between the primer layer 2 and a layer to be brought into contact with the layer 2. In addition, when the primer layer 2 is formed by using sol-based inorganic particles having a primary particle size of 200 nm or less, the adhesiveness between the primer layer 2 and a layer to be brought into contact with the layer and the heat resistance of the primer layer 2 can be extremely increased. It is presumed that these points also contribute to an improvement in the adhesiveness between the substrate 1 and the peel-off layer 4. Incidentally, it has been revealed from the results of Examples described later that occurrence of "reverse transfer" of the peel-off layer 4 can be inhibited by use of the primer layer 2 of First form, even not according to this mechanism.

The primary particle size of the sol-based inorganic particles referred to herein is a volume-average particle size calculated in compliance with JIS Z8819-2 (2001) and can be determined by a method of measuring the size of the sol-based inorganic particles directly from an electron micrograph. Specifically, sol-based inorganic particles are dried to prepare a dried product. The sol-based inorganic particles in the dried product are observed with a transmission electron microscope, and the minor axis diameter and major axis diameter of each of the sol-based inorganic particles were measured. Their average was taken as the particle size of the particles. Subsequently, with respect to 100 or more particles, the volume (weight) of each particle was determined by approximation to a rectangular parallelepiped of the particle size determined, and taken as the volume-average particle size. As the transmission electron microscope, a transmission electron microscope manufactured by Hitachi High-Technologies Corporation or the like can be used.

Incidentally, in the primer layer 2 of First form, the primary particle size of the sol-based inorganic particles is specified to be 200 nm or less because, in the case where a primer layer which is formed by using only sol-based inorganic particles having a primary particle size of more than 200 nm is used, the adhesiveness between the substrate 1 and the peel-off layer 4 cannot be sufficiently increased and thus, in the case where the energy to be applied to the thermal transfer sheet is increased and the like when the transfer layer of the intermediate transfer medium is removed, occurrence of "reverse transfer" cannot be inhibited. Incidentally, this does not exclude use of sol-based inorganic particles having a primary particle size of more than 200 nm. The primer layer of First form can be formed also by using sol-based inorganic particles having a primary particle size of 200 nm or less and sol-based inorganic particles having a primary particle size of more than 200 nm in combination. In this case, the mass (solid content) of the sol-based inorganic particles having a primary particle size of 200 nm or less on the basis of the total mass (solid content) of the sol-based inorganic particles having a primary particle size of 200 nm or less and the sol-based inorganic particles having a primary particle size of more than 200 nm is preferably 30% by mass or more, more preferably 50% by mass or more, particularly preferably 70% by mass or more (however, this shall not apply to the case where the primer layer of First form and a primer layer of Second form to Seventh form described later are combined).

Examples of the sol-based inorganic particles can include silica sol, alumina sol and colloidal alumina (alumina hydrate sol), zirconia sol, tin oxide sol, and titania sol. Among them, a primer layer 2 formed by using alumina sol having a primary particle size of 200 nm or less or silica sol having a primary particle size of 200 nm or less is preferable sol-based inorganic particles in respect of being able to further increase the adhesiveness between the substrate 1 and the primer layer 4. Alumina sol having a primary particle size of 200 nm or less is particularly preferable. The primer layer 2 of First form may be one formed by using one type of inorganic particles having a primary particle size of 200 nm or less, or may be one formed by using two or more types in combination.

Additionally, these is also no limitation with respect to the shape of sol-based inorganic particles having a primary particle size of 200 nm or less, and the particles may take any shape such as spherical, needle-like, plate-like, pennate, scale-like, and amorphous shapes.

There is no particular limitation with respect to the method for forming the primer layer 2 of First form, and the primer layer 2 can be formed by coating the substrate 1 with a coating liquid for a primer layer containing sol-based inorganic particles having a primary particle size of 200 nm or less by conventionally-known forming means such as a gravure coating method, a roll coating method, a screen printing method, or a reverse roll coating method using a gravure plate followed by drying. The coating liquid for a primer layer can be prepared by dispersing sol-based inorganic particles in an aqueous medium. Examples of the aqueous medium can include water, water-soluble alcohols such as isopropyl alcohol, and mixed liquids of water and a water-soluble alcohol.

The primer layer 2 of First form also can be formed by using sol-based inorganic particles having a primary particle size of 200 nm or less and a binder resin. Examples of the binder resin can include urethane resins, polyester resins, acryl type resins, vinyl chloride-vinyl acetate type copolymer resins, polyvinyl pyrrolidone resins, polyamide epoxy resins, and polyvinyl alcohol resins. In this case, the mass (solid content) of the sol-based inorganic particles having a primary particle size of 200 nm or less on the basis of the total mass (solid content) of the primer layer 2 of First form is preferably 50% by mass or more, more preferably 70% by mass or more (however, this shall not apply to the case where the binder resin is a resin satisfying the conditions of Third form to Seventh form described later.).

<Primer Layer of Second Form>

The primer layer 2 of Second form contains scale-like inorganic particles. By providing the primer layer 2 containing scale-like inorganic particles between the substrate 1 and the peel-off layer 4, the adhesiveness between the substrate 1 and the peel-off layer 4 can be improved, as above-described primer layer 2 of First form. Even in the case where the energy to be applied to the thermal transfer sheet is increased when the transfer layer of the intermediate transfer medium is removed, occurrence of "reverse transfer" in the peel-off layer 4 can be inhibited.

The scale-like inorganic particles referred to herein mean foliate inorganic particles formed by inorganic primary particles having a flake shape overlapping in several layers with their interfaces parallelly oriented to each other. The above-described effect produced by using the primer layer 2 of Second form is an effect exerted by using scale-like inorganic particles as inorganic particles to be contained in the primer layer 2. In the case where inorganic particles having a shape other than a scale-like shape, the adhesiveness between the substrate 1 and the peel-off layer 4 cannot be sufficiently satisfied (however, except the case where the primer layer 2 formed by using the sol-based inorganic particles having a primary particle size of 200 nm or less is used.).

The mechanism by which the adhesiveness between the substrate 1 and the peel-off layer 4 is improved by allowing scale-like inorganic particles to be contained has not been clarified so far. Scale-like inorganic particles are layered, with parallelly oriented to the substrate 1, in the primer layer 2 of Second form, and it is presumed that this form contributes to an improvement in the adhesiveness between the substrate 1 and the peel-off layer 4.

The primer layer 2 of Second form is under the condition that the layer 2 contains scale-like inorganic particles, and there is no particular limitation with respect to materials of the inorganic particles. Examples of the material can include scale-like silica (layered polysilicate), scale-like iron oxide, and scale-like titanate. The primer layer 2 of Second form may contain one type of scale-like inorganic particles or may contain two or more types thereof.

Among the scale-like inorganic particles exemplified above, the primer layer 2 of Second form preferably contains scale-like silica. Silica particles have extremely high heat resistance and have a property of preventing their thermophysical properties from changing by heat applied to the thermal transfer sheet on peeling-off. Accordingly, silica particles will not be a cause of reduction in the adhesiveness between the primer layer 2 and a layer to be brought into contact with the layer 2. In addition, in the case where primer layer 2 is formed by bonding of silanol groups by using scale-like silica as the silica particles, the adhesiveness between the primer layer 2 and a layer to be brought into contact with the layer 2 and the heat resistance of the primer layer 2 can be extremely increased. Thus, according to the primer layer 2 of Second form containing scale-like silica, even in the case where the energy to be applied to the thermal transfer sheet is increased when the transfer layer of the intermediate transfer medium is removed, reduction in the adhesiveness between the substrate 1 and the peel-off layer 4 can be inhibited by the improvement in the heat resistance. In other words, irrespective of the conditions under which the transfer layer of the intermediate transfer medium is removed, the satisfactory adhesiveness between the substrate 1 and the peel-off layer 4 can be maintained.

There is no particular limitation with respect to the method for forming the primer layer 2 of Second form, and the primer layer 2 can be formed by coating the substrate 1 with coating liquid for a primer layer containing scale-like inorganic particles, for example, a coating liquid for a primer layer containing a slurry prepared by dispersing inorganic particles having a shape of secondary particles formed by parallelly-overlapped scale-like inorganic particles (primary particles) or of tertiary particles formed by three-dimensionally aggregated secondary particles in water by conventionally-known forming means such as a gravure coating method, a roll coating method, a screen printing method, or a reverse roll coating method using a gravure plate followed by drying. According to this formation method, the primer layer 2 is formed due to its self-film-formability, and thus, a further improvement in the adhesiveness between the substrate 1 and the peel-off layer 4 can be anticipated.

The primer layer 2 of Second form may contain optional additives such as a binder resin and the like in addition to the scale-like inorganic particles. As the binder resin, the binder resins described in the primer layer of First form described above can be appropriately selected and used. Incidentally, in the case where the primer layer 2 of Second form contains optional additives, the content of the scale-like inorganic particles on the basis of the total solid content of the primer layer 2 of Second form is preferably 50% by mass or more, more preferably 70% by mass or more. Incidentally, the upper limit is not limited and is 100% by mass.

<Primer Layers of Third Form and Fourth Form>

The primer layer 2 of Third form contains a polyvinyl pyrrolidone type resin having a glass-transition temperature (Tg) of 60° C. or more, and the primer layer 2 of Fourth form contains a polyester type resin having a glass-transition temperature (Tg) of 60° C. or more. By providing the primer layer 2 containing a polyvinyl pyrrolidone type resin having a glass-transition temperature (Tg) of 60° C. or more and a polyester type resin having a glass-transition temperature (Tg) of 60° C. or more between the substrate 1 and the peel-off layer 4, the adhesiveness between the substrate 1 and the peel-off layer 4 can be sufficiently satisfied as described above. Additionally by satisfying a condition of a glass-transition temperature (Tg) of 60° C. or more, the heat resistance of the primer layer 2 of Third form or Fourth form can be improved, and even in the case where the energy to be applied to the thermal transfer sheet is increased when the transfer layer of the intermediate transfer medium is removed, reduction in the adhesiveness between the substrate 1 and the peel-off layer 4 can be inhibited by the improvement in the heat resistance. Incidentally, the glass-transition temperature (Tg) referred to herein means a temperature determined in compliance with JIS K7121:2012 and on the basis of measurement of a change of calorie (DSC method) in accordance with the DSC (differential scanning calorimetry).

The polyvinyl pyrrolidone type resin referred to herein includes copolymers of a vinyl pyrrolidone resin and another resin in addition to polyvinyl pyrrolidone resins. For example, as the polyvinyl pyrrolidone type resin, vinyl acetate-vinyl pyrrolidone copolymers can be used. The polyvinyl pyrrolidone resin can be obtained by polymerizing N-vinyl-2-pyrrolidone, for example.

The polyester type resin referred to herein means a polymer containing ester groups obtained by polycondensation from a polycarboxylic acid and a polyhydric alcohol. Examples of the polycarboxylic acid include terephthalic acid, isophthalic acid, phthalic acid, 2,6-naphthalene dicarboxylic acid, adipic acid, sebacic acid, decanedicarboxylic acid, azelaic acid, dodecanedicarboxylic acid, and cyclohexanedicarboxylic acid. Examples of the polyhydric alcohol include ethylene glycol, propanediol, butanediol, pentanediol, hexanediol, neopentyl glycol, 1,4-cyclohexane dimethanol, decanediol, 2-ethyl-butyl-1-propanediol, and bisphenol A. Furthermore, the polyester type resin may be copolymer of three or more of polycarboxylic acids and polyhydric alcohols, and may be a copolymer with a monomer or a polymer such as diethylene glycol, triethylene glycol, and polyethylene glycol. Additionally, the polyester type resin referred to herein includes modified forms of the polyester type resin described above. Examples of the modified form of the polyester type resin can include polyester urethane resins.

Incidentally, in the primer layer 2 of Third form and Fourth form, the glass-transition temperature (Tg) of the polyvinyl pyrrolidone type resin and the polyester type resin is specified to be 60° C. or more because, in the case where a primer layer containing a polyvinyl pyrrolidone type resin or a polyester type resin having a glass-transition temperature (Tg) of less than 60° C. without containing a polyvinyl pyrrolidone type resin or a polyester type resin having a glass-transition temperature (Tg) of 60° C. or more is used, the heat resistance of the primer layer cannot be sufficiently increased and thus, in the case where the energy to be applied to the thermal transfer sheet is increased when the transfer layer of the intermediate transfer medium is removed, the adhesiveness between the substrate 1 and the peel-off layer 4 cannot be maintained. In other words, this is because occurrence of "reverse transfer" of the peel-off layer cannot be sufficiently inhibited. Although details are unknown, even if the glass-transition temperature (Tg) is 60° C. or more, in the case where the resin having a glass-transition temperature (Tg) of 60° C. or more is a resin other than polyvinyl pyrrolidone type resins and polyester type resins (except for resins satisfying the conditions of Fourth form to Seventh form described later), the adhesiveness between the substrate 1 and the peel-off layer 4 cannot be sufficiently increased.

Incidentally, the primer layer 2 of Third form and Fourth form is under the condition that the layer 2 contains a polyvinyl pyrrolidone type resin having a glass-transition temperature (Tg) of 60° C. or more or a polyester type resin having a glass-transition temperature (Tg) of 60° C. or more. However, in the case where a further improvement in the adhesiveness between the substrate 1 and the peel-off layer 4 is intended, the primer layer 2 of Third form and Fourth form contains a polyvinyl pyrrolidone type resin having a glass-transition temperature (Tg) of 80° C. or more, more preferably a glass-transition temperature (Tg) of 150° C. or more or a polyester type resin having a glass-transition temperature (Tg) of 80° C. or more, more preferably a glass-transition temperature (Tg) of 100° C. or more.

The primer layer 2 of Third form and Fourth form may contain a resin not satisfying the conditions described above, various additives, and the like, and the content of the polyvinyl pyrrolidone type resin having a glass-transition temperature (Tg) of 60° C. or more on the basis of the total solid content of the primer layer 2 of Third form is preferably 50% by mass or more, more preferably 70% by mass or more. The same applies to the preferable content of the polyester type resin having a glass-transition temperature (Tg) of 60° C. or more on the basis of the total solid content of the primer layer 2 of Fourth form (however, this shall not apply to the case where the resin not satisfying the conditions described above and additives are those satisfying the conditions of First form, Second form, and Fifth form to Seventh form described later.).

There is no particular limitation with respect to the method for forming the primer layer 2 of Third form and Fourth form, and the primer layer 2 can be formed by preparing a coating liquid for a primer layer in which a polyvinyl pyrrolidone type resin having a glass-transition temperature (Tg) of 60° C. or more or a polyester type resin having a glass-transition temperature (Tg) of 60° C. or more, various resins to be added as required, and additives are dissolved or dispersed in an appropriate solvent and coating the substrate 1 with the coating liquid by conventionally-known forming means such as a gravure coating method, a roll coating method, a screen printing method, or a reverse roll coating method using a gravure plate followed by drying.

<Primer Layer of Fifth Form>

The primer layer 2 of Fifth form contains a polyurethane type resin having a thermal melting temperature (Ts) of 100° C. or more. By providing the primer layer 2 containing the polyurethane type resin having a thermal melting temperature (Ts) of 100° C. or more between the substrate 1 and the peel-off layer 4, the adhesiveness between the substrate 1 and the peel-off layer 4 can be sufficiently satisfied as the primer layer 2 of each form described above. Additionally by satisfying the condition of the thermal melting temperature (Ts) of 100° C. or more, the heat resistance of the primer layer 2 can be improved, and even in the case where the energy to be applied to the thermal transfer sheet is increased when the transfer layer of the intermediate transfer medium is removed, reduction in the adhesiveness between the substrate 1 and the peel-off layer 4 can be inhibited by the improvement in the heat resistance. Incidentally, the thermal melting temperature (Ts) referred to herein means a temperature calculated in compliance with JISK7121:2012 and by using a flow starting temperature from a Koka type flow tester. As the flow tester, for example, a Koka type flow tester CFT-500C manufactured by SHIMADZU CORPORATION can be used.

The polyurethane type resin referred to herein is a resin containing a polyol (polyhydric alcohol) as the base agent and isocyanate as the crosslinking agent (curing agent). The polyol is one having two or more hydroxyl groups per molecule, and examples can include polyethylene glycol, polypropylene glycol, acryl polyol, polyester polyol, polyether polyol, and alkyd-modified acryl polyol. The polyurethane type resin may be an aqueous polyurethane type resin which may form a stable dispersion liquid in an aqueous medium, for example, water, water-soluble alcohols such as isopropyl alcohol, and mixed liquids of water and a water-soluble alcohol, and may be a solvent-based polyurethane type resin which can be dissolved or dispersed in an organic solvent.

In the primer layer 2 of Fifth form, the thermal melting temperature (Ts) of the polyurethane type resin is specified to be 100° C. or more because, in case where a primer layer containing a polyurethane type resin having a thermal melting temperature (Ts) of less than 100° C. without containing a polyurethane type resin having a thermal melting temperature (Ts) of 100° C. or more is used, the interlayer adhesiveness between the substrate 1 and the peel-off layer 4 cannot be sufficiently satisfied, and thus, in the case where the energy to be applied to the thermal transfer sheet is increased when the transfer layer of the intermediate transfer medium is removed, the occurrence of "reverse transfer" of the peel-off layer cannot be sufficiently inhibited. Although details are unknown, even if the thermal melting temperature (Ts) is 100° C. or more, in the case where this resin having a thermal melting temperature (Ts) of 100° C. or more is not a polyurethane type resin (except for resins satisfying the conditions of Third form, Fourth form, Sixth form, and Seventh form), the adhesiveness between the substrate 1 and the peel-off layer 4 cannot be sufficiently satisfied.

The primer layer 2 of Fifth form may contain a resin not satisfying the conditions described above, for example, a polyurethane type resin having a thermal melting temperature (Ts) of less than 100° C. or a resin other than polyurethane type resins, various additives and the like, and the content of polyurethane type resin having a thermal melting temperature (Ts) of 100° C. or more on the basis of the total solid content of the primer layer 2 of Fifth form is preferably 50% by mass or more, more preferably 70% by mass or more (however, this shall not apply to the case where the resin not satisfying the conditions described above and additives are those satisfying the conditions of First form to Fourth form, Sixth form, and Seventh form.).

There is no particular limitation with respect to the method for forming the primer layer 2 of Fifth form, and the primer layer 2 can be formed by preparing a coating liquid for a primer layer in which a polyurethane type resin having a thermal melting temperature (Ts) of 100° C. or more, an optional resin to be added as required, and additives are dispersed in an aqueous medium and coating the substrate 1 with the coating liquid by conventionally-known forming means such as a gravure coating method, a roll coating method, a screen printing method, or a reverse roll coating method using a gravure plate followed by drying.

<Primer Layer of Sixth Form>

The primer layer 2 of Sixth form contains a resin formed by curing a thermoplastic resin having a glass-transition temperature (Tg) of 40° C. or more. Hereinbelow, the resin formed by curing a thermoplastic resin having a glass-transition temperature (Tg) of 40° C. or more is referred to as a "first cured resin". By providing the primer layer 2 of Sixth form containing the "first cured resin" between the substrate 1 and the peel-off layer 4, the adhesiveness between the substrate 1 and the peel-off layer 4 can be sufficiently satisfied as the primer layer 2 of each form described above. Additionally, by allowing the primer layer to contain the "first cured resin" formed by curing a thermoplastic resin having a glass-transition temperature (Tg) of 40° C. or more, the heat resistance of the primer layer 2 can be improved, and even in the case where the energy to be applied to the thermal transfer sheet is increased when the transfer layer of the intermediate transfer medium is removed, reduction in the interlayer adhesiveness between the substrate 1 and the peel-off layer 4 can be inhibited by the improvement in the heat resistance. In other words, irrespective of the conditions under which the transfer layer of the intermediate transfer medium is removed, the satisfactory adhesiveness between the substrate 1 and the peel-off layer 4 can be maintained.

Incidentally, the glass-transition temperature (Tg) of the thermoplastic resin for obtaining the "first cured resin" is specified to be 40° C. or more because, in the case where a primer layer containing a cured resin formed by curing a thermoplastic resin having a glass-transition temperature (Tg) of less than 40° C. (except for polyvinyl alcohol type resins) without containing the "first cured resin" is used, the heat resistance of the primer layer cannot be sufficiently satisfied, and in the case where the energy to be applied to the thermal transfer sheet is increased when the transfer layer of the intermediate transfer medium is removed, the interlayer adhesiveness between the substrate 1 and the peel-off layer 4 becomes decreasing, and thus, the occurrence of "reverse transfer" of the peel-off layer cannot be sufficiently inhibited.

There is no particular limitation with respect to the thermoplastic resin for obtaining the "first cured resin", and a thermoplastic resin having a glass-transition temperature (Tg) of 40° C. or more can be appropriately selected and used. Examples of such a thermoplastic resin can include polyvinyl pyrrolidone resins, urethane type resins, polyester type resins, polyacrylic ester type resins, polyvinyl acetate type resins, styrene acrylate type resins, polyacrylamide type resins, polyamide type resins, polyether type resins, polystyrene type resins, polyethylene type resins, polypropylene type resins, vinyl type resins such as polyvinyl chloride resins, polyvinyl alcohol resins, and polyvinyl pyrrolidone, polyvinyl acetal type resins such as polyvinyl acetoacetal and polyvinyl butyral, and acryl type resins such as acryl polyols which satisfy the condition of the glass-transition temperature (Tg) of 40° C. or more. These thermoplastic resins may be used solely or in combination of two or more thereof.

The curing agent for obtaining the "first cured resin" may be appropriately selected depending on the thermoplastic resin having a glass-transition temperature (Tg) of 40° C. or more. Examples of the curing agent can include isocyanate type curing agents, and metal chelating agents such as titanium chelating agents, zirconium chelating agents, and aluminum chelating agents.

The primer layer 2 of Sixth form may contain a cured resin not satisfying the conditions described above, for example, a cured resin formed by curing a thermoplastic resin having a glass-transition temperature (Tg) of less than 40° C. (except for polyvinyl alcohol type resins), a resin other than the "first cured resin", various additives, and the like, and the content of the "first cured resin" on the basis of the total solid content of the primer layer 2 of Sixth form is preferably 50% by mass or more, more preferably 70% by mass or more (however, this shall not apply to the case where the resin not satisfying the conditions described above and additives are those satisfying the conditions of First form to Fifth form, and Seventh form described later.).

There is no particular limitation with respect to the method for forming the primer layer 2 of Sixth form, and the primer layer 2 can be formed by preparing a coating liquid for a primer layer in which a thermoplastic resin having a glass-transition temperature (Tg) of 40° C. or more, an optional resin to be added as required, and additives are dissolved or dispersed in an appropriate solvent and coating the substrate 1 with the coating liquid by conventionally-known forming means such as a gravure coating method, a roll coating method, a screen printing method, or a reverse roll coating method using a gravure plate followed by drying.

<Primer Layer of Seventh Form>

The primer layer 2 of Seventh form contains a resin formed by curing a polyvinyl alcohol type resin. Hereinbelow, the resin formed by curing a polyvinyl alcohol type resin is referred to as a "second cured resin". By providing the primer layer 2 of Seventh form containing the "second cured resin" between the substrate 1 and the peel-off layer 4, the adhesiveness between the substrate 1 and the peel-off layer 4 can be sufficiently satisfied as the primer layer 2 of each form described above. Also as the primer layer of Sixth form described above, the heat resistance of the primer layer 2 can be improved, and even in the case where the energy to be applied to the thermal transfer sheet is increased when the transfer layer of the intermediate transfer medium is removed, reduction in the interlayer adhesiveness between the substrate 1 and the peel-off layer 4 can be inhibited by the improvement in the heat resistance. In other words, irrespective of the conditions under which the transfer layer of the intermediate transfer medium is removed, the satisfactory adhesiveness between the substrate 1 and the peel-off layer 4 can be maintained.

The polyvinyl alcohol type resin means a resin having a vinyl alcohol polymer in its constituents. In a preferable primer layer 2 of Seventh form, as the polyvinyl alcohol type resin for obtaining the "second cured resin", a polyvinyl alcohol type resin having a number-average degree of polymerization of 500 or more and 3500 or less, more preferably 1700 or more and 3500 or less. When the primer layer 2 of Seventh form containing the "second cured resin" obtained by curing such a polyvinyl alcohol type resin is used, the primer layer can have higher heat resistance. Examples of the polyvinyl alcohol type resin for obtaining the "second cured resin" include polyvinyl alcohols such as GOHSENOL KH-20 (manufactured by The Nippon Synthetic Chemical Industry Co., Ltd.), GOHSENOL N-300 (manufactured by The Nippon Synthetic Chemical Industry Co., Ltd.), KURARAY POVAL PVA-235 (manufactured by KURARAY CO., LTD.), and KURARAY POVAL PVA-117 (manufactured by KURARAY CO., LTD.), GOHSEFIMER Z-200 and GOHSEFIMER Z-320 (manufactured by The Nippon Synthetic Chemical Industry Co., Ltd.), which are acetoacetylated polyvinyl alcohol having acetoacetyl groups and high reactivity, and S-LEC KX series (manufactured by SEKISUI CHEMICAL CO., LTD.) and S-LEC KW series (manufactured by SEKISUI CHEMICAL CO., LTD.), which are aqueous polyvinyl acetal obtained by acetal-modifying a portion of alcohol groups in polyvinyl alcohol. Incidentally, the degree of acetalization of the polyvinyl alcohol type resin is preferably 0 mol % or more and 33 mol % or less, more preferably 0 mol % or more and 11 mol % or less.

The curing agent for obtaining the "second cured resin" is not particularly limited provided that the curing agent is one that can cure the polyvinyl alcohol type resin, and examples include isocyanates, aqueous titanium chelating agents, aluminum chelating agents, zirconyl chloride compounds, glyoxal, trimethylolmelamine, and dimethylolurea. Among these, in respect of being able to impart excellent heat resistance to the primer layer of Seventh form, isocyanates, aqueous titanium chelating agents, aluminum chelating agents, and zirconyl chloride compounds are preferable. Specifically, commercially available products including, as the isocyanate, DURANATE WB40-100 (manufactured by Asahi Kasei Chemicals Corporation) and the like, as the aqueous titanium chelating agent, ORGATIX TC-300 (manufactured by Matsumoto Fine Chemical Co., Ltd.), ORGATIX TC-310 (manufactured by Matsumoto Fine Chemical Co., Ltd.), ORGATIX TC-315 (manufactured by Matsumoto Fine Chemical Co., Ltd.) and the like, as the aluminum chelating agent, Aluminum Chelate D (manufactured by Kawaken Fine Chemicals Co., Ltd.) and the like, as the zirconyl chloride compound, ORGATIX ZB-126 (manufactured by Matsumoto Fine Chemical Co., Ltd.) and the like can be suitably used. The total content of the polyvinyl alcohol type resin and the curing agent is preferably 65% by mass or more and 100% by mass or less, more preferably 80% by mass or more and 100% by mass or less, on the basis of the total solid content constituting the primer layer of Seventh form. The content of the curing agent is preferably 10% by mass or more and 75% by mass or less, more preferably 25% by mass or more and 60% by mass or less, on the basis of the total amount of the polyvinyl alcohol type resin and the curing agent constituting the primer layer of Seventh form. Within the range described above, a primer layer having desired flexibility, heat resistance, strength and the like can be formed. Incidentally, by using these curing agents, a robust crosslinked structure can be formed only by a drying step and thus, the production suitability is excellent.

The primer layer 2 of Seventh form may contain a resin other than the "second cured resin", various additives, and the like, and the content of the "second cured resin" on the basis of the total solid content of the primer layer 2 of Seventh form is preferably 50% by mass or more, more preferably 70% by mass or more (however, this shall not apply to the case where the resin other than the "second cured resin" and additives are those satisfying the conditions of First form to Sixth form.).

There is no particular limitation with respect to the method for forming the primer layer 2 of Seventh form, and the primer layer 2 can be formed by preparing a coating liquid for a primer layer in which a polyvinyl alcohol type resin, an optional resin to be added as required, and additives are dissolved or dispersed in an appropriate solvent and coating the substrate 1 with the coating liquid by conventionally-known forming means such as a gravure coating method, a roll coating method, a screen printing method, or a reverse roll coating method using a gravure plate followed by drying.

<Primer Layer of Eighth Form>

The primer layer of Eighth form is in a form in which the primer layer 2 of the above-described First form to the above-described Seventh form are combined. In other words, the primer layer 2 of Eighth form contains two or more selected from the group of inorganic particles derived from sol-based inorganic particles having a primary particle size of 200 nm or less, scale-like inorganic particles, a polyvinyl pyrrolidone type resin having a glass-transition temperature (Tg) of 60° C. or more, a polyester type resin having a glass-transition temperature (Tg) of 60° C. or more, a polyurethane type resin having a thermal melting temperature of 100° C. or more, a resin formed by curing a thermoplastic resin having a glass-transition temperature (Tg) of 40° C. or more (the "first cured resin" described above), and a resin formed by curing a polyvinyl alcohol type resin (the "second cured resin" described above). By providing the primer layer 2 of Eighth form between the substrate 1 and the peel-off layer 4, the adhesiveness between the substrate 1 and the peel-off layer 4 can be sufficiently satisfied as the primer layer 2 of each form described above.

The primer layer 2 of Eighth form may contain a resin other than the group described above and additives, and the total mass of two or more selected from the group described above on the basis of the total solid content of the primer layer 2 of Eighth form is preferably 50% by mass or more, more preferably 70% by mass or more.

There is no particular limitation with respect to the thickness of the primer layer 2 of each form described above, but in the case where the thickness of the primer layer 2 is less than 0.03 μm, it becomes difficult to allow the substrate 1 to adhere to the peel-off layer 4 with sufficient strength. Alternatively, when the thickness of the primer layer 2 becomes too large, the thermal sensitivity is reduced, and the peel-off property on removal of the transfer layer of the intermediate transfer medium tends to be reduced. Considering these points, the thickness of the primer layer 2 is preferably 0.03 μm or more, more preferably 0.06 μm or more. The upper limit is not particularly limited, and it is of the order of 1 μm.

(Peel-off Layer)

The peel-off layer 4 constituting the thermal transfer sheet 10 of one embodiment is a layer that serves to remove a portion of the transfer layer 31 of the intermediate transfer medium 30, as shown in FIG. 2. Specifically, the transfer layer 31 of the intermediate transfer medium 30 and the peel-off layer 4 of the thermal transfer sheet 10 are superposed on each other, and energy is applied to the back face side of the thermal transfer sheet 10 by means of a heating device 16 such as a thermal head. The peel-off layer 4 is a layer for removing the transfer layer 31 located at a position corresponding to the region to which energy has been applied. Incidentally, the intermediate transfer medium 30 in the form shown in FIG. 2 and FIG. 3 has a structure in which the transfer layer 31 is provided on the substrate.

There is no particular limitation with respect to the materials of the peel-off layer 4, and, for example, a conventionally-known thermoplastic resin can be appropriately selected and used. Examples of such a resin can include vinyl chloride resins, vinyl chloride-vinyl acetate copolymer resins, acryl type resins, polyester resins, polyamide resins, styrene acryl resins, styrene-vinyl chloride-vinyl acetate copolymers, butyral resins, epoxy resins, and polyamide resins. Among these, vinyl chloride-vinyl acetate copolymer resins, acryl type resins, polyester resins, and mixed resins of a vinyl chloride-vinyl acetate copolymer resin and an acryl type resin are preferable in respect of having high interlayer adhesiveness with the primer layer 2 of each form described above and a satisfactory peel-off property. The peel-off layer 4 may contain one resin solely or may contain two or more resins.

A preferable peel-off layer 4 contains a thermoplastic resin having a glass-transition temperature (Tg) of 45° C. or more or a thermoplastic resin having a number average molecule weight (Mn) of 6000 or more. The peel-off layer 4 contains particularly preferably a thermoplastic resin having a glass-transition temperature (Tg) of 60° C. or more or a number average molecule weight (Mn) of 10000 or more, more preferably a thermoplastic resin having a glass-transition temperature (Tg) of 60° C. or more and a number average molecule weight (Mn) of 10000 or more. According to the peel-off layer 4 of a preferred form, the thermal transfer sheet 10 becomes extremely satisfactory in the heat resistance and peel-off property, in combination with the action of the primer layer 2 described below. Incidentally, the number average molecular weight (Mn) referred to herein means a value in terms of polystyrene standard measured in compliance with JIS K7252-1:2008 and by Gel Permeation Chromatography (GPC).

There is no particular limitation with respect to the method for forming the peel-off layer 4, and the peel-off layer 4 can be formed by preparing a coating liquid for a peel-off layer in which a resin exemplified above and additives such as an inorganic or organic filler to be added as required are added and coating the primer layer 2 with this coating liquid by known means such as gravure coating, gravure reverse coating, and roll coating followed by drying.

There is no particular limitation with respect to the thickness of the peel-off layer 4, but with a thickness of less than 0.1 μm, the adhesive property between the transfer layer and the peel-off layer on removal of the transfer layer of the intermediate transfer medium and the film strength of peel-off layer cannot be sufficiently satisfied. In contrast, with a thickness of more than 4 μm, the thermal sensitivity is reduced, and the adhesive property with the transfer layer of the intermediate transfer medium tends to be reduced. Considering these points, the thickness of the peel-off layer 4 is preferably 0.1 μm or more and 4 μm or less, more preferably 0.2 μm or more and 2 μm or less. Incidentally, as the film strength of the peel-off layer 4 is reduced, the problem of insufficient removal of the transfer layer tends to occur.

(Back Face Layer)

In the thermal transfer sheet 10 of the form shown in FIG. 1, a back face layer 5 is provided on the surface opposite to the surface on which the primer layer 2 of the substrate 1 is provided. Incidentally, the back face layer 5 is an optional constituent in the thermal transfer sheet 10 of one embodiment.

There is no limitation with respect to the materials of the back face layer 5, and examples can include single resins or mixtures of natural or synthetic resins such as cellulosic resins, such as ethyl cellulose, hydroxy cellulose, hydroxypropyl cellulose, methyl cellulose, cellulose acetate, cellulose acetate butyrate, and nitro cellulose; vinyl type resins, such as polyvinyl alcohol, polyvinyl acetate, polyvinyl butyral, polyvinyl acetal, and polyvinyl pyrrolidone; acrylic resins, such as polymethyl methacrylate, polyethyl acrylate, polyacrylamide, and acrylonitrile-styrene copolymer; polyamide resins; polyvinyltoluene resins; coumarone-indene resins; polyester type resins; polyurethane resins; and silicone-modified or fluorine-modified urethanes.

The back face layer 5 may also contain a solid or liquid lubricant. Examples of the lubricant can include various waxes, such as polyethylene wax and paraffin wax, higher aliphatic alcohols, organo polysiloxanes, anionic surfactants, cationic surfactants, amphoteric surfactants, nonionic surfactants, fluorine-based surfactants, organic carboxylic acids and derivatives thereof, metal soaps, fluorine type resins, silicone type resins, and fine particles of inorganic compounds such as talc and silica. The mass of the lubricant on the basis of the total mass of the back face layer 5 is in the range of 5% by mass or more and 50% by mass or less, preferably 10% by mass or more and 30% by mass or less.

There is no particular limitation with respect to the method for forming the back face layer 5, and the back face layer 5 can be formed by preparing a coating liquid for a back face layer in which a resin, a lubricant to be added as required and the like are dissolved or dispersed in an appropriate solvent and coating the substrate 1 with this coating liquid by a conventional coating device such as a gravure coater, a roll coater, and a wire bar followed by drying. The thickness of the back face layer 5 is preferably in the range of 1 μm or more and 10 μm or less.

Figure 4:
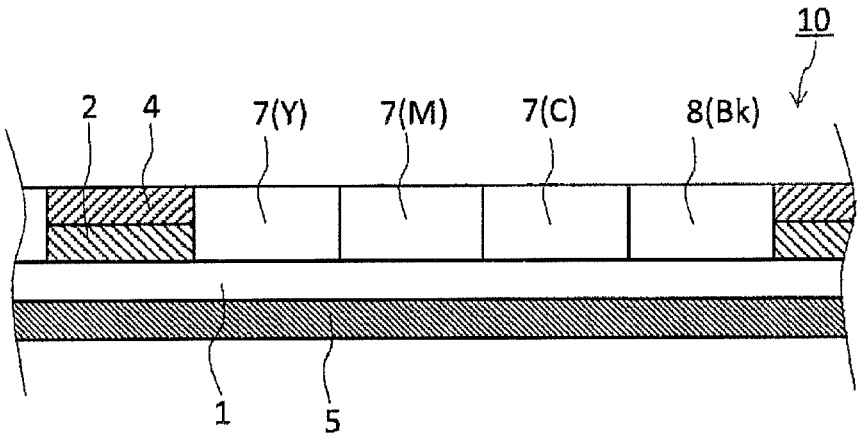
FIG. 4 is a schematic sectional view of a thermal transfer sheet of one embodiment.

The thermal transfer sheet 10 of one embodiment may also take a structure in which individual dye layers 7 of yellow (Y), magenta (M) and cyan (C), and a fusible layer 8 of black (Bk) are provided as being frame sequentially on the same surface of the substrate 1, on which the peel-off layer 4 is provided, as shown in FIG. 4. Incidentally, the dye layers 7 and the fusible layer 8 are optional constituents in the thermal transfer sheet 10 of one embodiment. Alternatively, instead of these optional layers, or as being frame sequentially with these layers, a transfer layer of a single layer structure including a protective layer or of a layered structure (not shown) can also be provided.

(Dye Layer)

The dye layers 7 are formed from a coating liquid containing a sublimable dye, a binder resin, and other optional ingredients. The sublimable dye, the binder resin and the like may be conventionally-known ones and are not particularly limited. The dye layers may be formed by a method, which includes preparing a coating liquid for a dye layer and applying and drying the coating liquid onto a substrate 1 by means such as a gravure printing method. The thickness of the dye layers is usually in the range of 0.2 μm or more and 3 μm or less.

Also, a conventionally-known dye primer layer (not shown) may be provided between the substrate 1 and the dye layers 7.

(Fusible Layer)

The fusible layer 8 may be formed by using conventionally-known thermally-fusible ink, and various additives are added thereto as required. These materials may be conventionally-known ones and are not particularly limited. The fusible layer 8 is formed by coating the substrate 1 with the thermally-fusible ink by using a method such as a gravure printing method and hot-melt coating followed by drying. The thickness of the fusible layer is determined from a relationship between necessary density and thermal sensitivity and is usually in the range of 0.2 μm or more and 10 μm or less.

<Peel-off Region>

Figure 5:
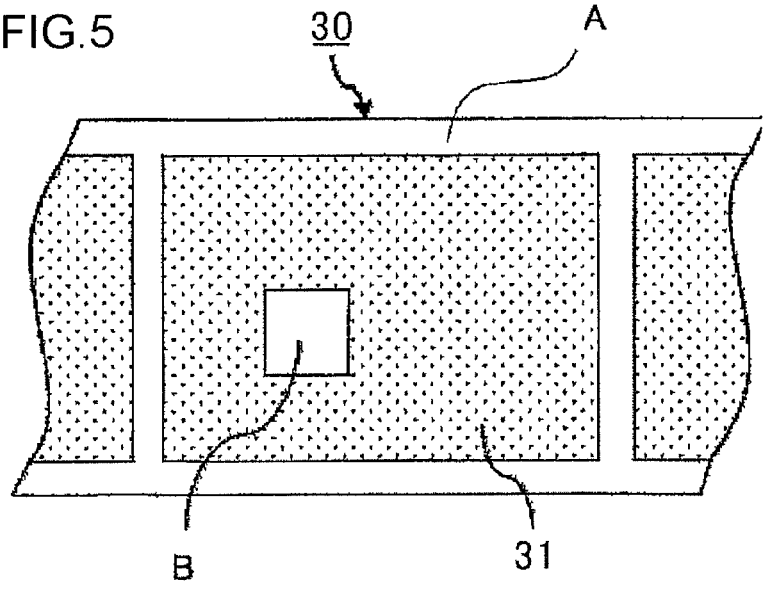
FIG. 5 is a schematic plan view of an intermediate transfer medium to be used in combination with the thermal transfer sheet of one embodiment.

Subsequently, an example of a region from which the transfer layer 31 of the intermediate transfer medium 30 is removed by using the thermal transfer sheet 10 of one embodiment will be described, with reference to FIG. 5. FIG. 5 is a schematic plan view of an intermediate transfer medium 30 to be used in combination with the thermal transfer sheet 10 of one embodiment. The blank regions (signs A and B in the figure) are the regions removed by means of the peel-off layer 4 of the thermal transfer sheet 10 of one embodiment.

There is no particular limitation with respect to the region from which the transfer layer 31 is removed, and examples can include the outer circumference portion of the transfer layer 31 to be transferred onto a transfer receiving article, as shown by the sign A of FIG. 5. In other words, it is also possible to remove the region not to be transferred onto the transfer receiving article so as to extract the circumference by means of the peel-off layer 4. Also, as shown by the sign B of FIG. 5, in the transfer receiving article onto which the transfer layer 31 is to be transferred eventually, examples can include the region onto which an ancillary product such as an IC chip and a signature portion is mounted, that is, the region that causes an disadvantage if the transfer layer 31 is remaining in the transfer receiving article onto which the transfer layer 31 has been transferred.

The thermal transfer sheet 10 of one embodiment, which makes the interlayer adhesiveness between the primer layer 2 and the peel-off layer 4 extremely satisfactory by means of the primer layer 2, can inhibit occurrence of reverse transfer of the peel-off layer 4 when the predetermined region of transfer layer 31 of the intermediate transfer medium 30 is removed by means of the peel-off layer 4, as described above, and can make the peel-off property satisfactory. That is, the transfer layer 31 can be accurately removed.

The intermediate transfer medium used in combination with the thermal transfer sheet 10 of one embodiment is not limited to the forms shown and can be applied to any of conventionally-known intermediate transfer media.

EXAMPLES

The present invention now will be described more specifically by referring to examples. Unless otherwise specified below, the part is based on the mass. Tg means a glass-transition temperature, and Ts means thermal melting temperature. The particle size is a primary particle size.

Example 1

Using a polyethylene terephthalate film having a thickness of 4.5 μm as the substrate, one surface of the substrate was coated with a coating liquid for a primer layer 1 having the following composition to thereby form a primer layer. Subsequently, the primer layer was coated with a coating liquid for a peel-off layer having the following composition to thereby form a peel-off layer. Additionally, the other surface of the substrate was coated with a coating liquid for a back face layer having the following composition at a thickness of 0.8 g/m$^2$ in the dried state to form a back face layer, and then, a thermal transfer sheet of Example 1 was obtained. The coating amount of the coating liquid for a primer layer 1 is 0.2 g/m$^2$ at the thickness in the dried state, and the coating amount of the coating liquid for a peel-off layer is 1.0 g/m$^2$ at the thickness in the dried state.

<Coating Liquid for Primer Layer 1>

| | |
|---|---|
| Alumina sol (solid content 10.5%) (Alumina sol-200 (particle size 10 nm × 100 nm), Nissan Chemical Industries, Ltd.) | 50 parts (solid content 5.25 parts) |
| Water/isopropyl alcohol mixed solvent (1:1) | 50 parts |

| <Coating liquid for peel-off layer> | |
|---|---|
| Vinyl chloride-vinyl acetate copolymer resin (SOLBIN C5R, Nissin Chemical Industry Co., Ltd.) | 10 parts |
| Acryl type resin (Diyanal BR-83, Mitsubishi Rayon Co., Ltd.) | 10 parts |
| Methyl ethyl ketone | 80 parts |
| <Coating liquid for back face layer> | |
| Polyvinyl butyral resin (S-LEC BX-1, SEKISUI CHEMICAL CO., LTD.) | 2.0 parts |
| Polyisocyanate (BURNOCK D750, DIC Corporation) | 9.2 parts |
| Phosphoric acid ester-based surfactant (PLYSURF A208N, DKS Co. Ltd.) | 1.3 parts |
| Talc (MICRO ACE P-3, NIPPON TALC Co., Ltd.) | 0.3 parts |
| Toluene | 43.6 parts |
| Methyl ethyl ketone | 43.6 parts |

Example 2

The thermal transfer sheet of Example 2 was obtained totally in the same manner as in Example 1 except that the coating liquid for a primer layer 1 was replaced by a coating liquid for a primer layer 2 having the following composition.

<Coating Liquid for Primer Layer 2>

| | |
|---|---|
| Scale-like silica (solid content 15.5%) (SUNLOVELY LFS HN-050, AGC Si-Tech Co., Ltd.) | 33 parts (solid content 5.12 parts) |
| Water/isopropyl alcohol mixed solvent (1:1) | 67 parts |

Example 3

The thermal transfer sheet of Example 3 was obtained totally in the same manner as in Example 1 except that the coating liquid for a primer layer 1 was replaced by a coating liquid for a primer layer 3 having the following composition.

<Coating Liquid for Primer Layer 3>

| | |
|---|---|
| Polyvinyl pyrrolidone resin (Tg: 174° C.) (PVP K-90, ISP Japan Ltd.) | 5 parts |
| Water/isopropyl alcohol mixed solvent (1:1) | 95 parts |

Example 4

The thermal transfer sheet of Example 4 was obtained totally in the same manner as in Example 1 except that the coating liquid for a primer layer 1 was replaced by a coating liquid for a primer layer 4 having the following composition.

<Coating Liquid for Primer Layer 4>

| | |
|---|---|
| PVP/VA Copolymer (vinyl acetate-vinyl pyrrolidone copolymer) (solid content 50%, Tg: 69° C.) (E-335, ISP Japan Ltd.) | 10 parts (solid content 5 parts) |
| Water/isopropyl alcohol mixed solvent (1:1) | 90 parts |

Example 5

The thermal transfer sheet of Example 5 was obtained totally in the same manner as in Example 1 except that the coating liquid for a primer layer 1 was replaced by a coating liquid for a primer layer 5 having the following composition.

<Coating Liquid for Primer Layer 5>

| | |
|---|---|
| Alumina sol (solid content 10.5%) (Alumina sol-200 (particle size 10 nm × 100 nm), Nissan Chemical Industries, Ltd.) | 35.1 parts (solid content 3.69 parts) |
| Polyvinyl pyrrolidone resin (Tg: 174° C.) (PVP K-90, ISP Japan Ltd.) | 1.6 parts |
| Water/isopropyl alcohol mixed solvent (1:1) | 63.3 parts |

Example 6

The thermal transfer sheet of Example 6 was obtained totally in the same manner as in Example 1 except that the coating liquid for a primer layer 1 was replaced by a coating liquid for a primer layer 6 having the following composition.

<Coating Liquid for Primer Layer 6>

| | |
|---|---|
| Silica sol (solid content 30.5%, particle size 8-11 nm) (SNOWTEX S, Nissan Chemical Industries, Ltd.) | 18 parts (solid content 5.49 parts) |
| Water/isopropyl alcohol mixed solvent (1:1) | 82 parts |

Example 7

The thermal transfer sheet of Example 7 was obtained totally in the same manner as in Example 1 except that the coating liquid for a primer layer 1 was replaced by a coating liquid for a primer layer 7 having the following composition.

<Coating Liquid for Primer Layer 7>

| | |
|---|---|
| Silica sol (solid content 30.5%, particle size 10-20 nm) (SNOWTEX 30, Nissan Chemical Industries, Ltd.) | 16 parts (solid content 4.88 parts) |
| Urethane resin (solid content 30%, Ts: 90° C.) (AP-20, DIC Corporation) | 2 parts (solid content 0.6 parts) |
| Water/isopropyl alcohol mixed solvent (1:1) | 82 parts |

Example 8

The thermal transfer sheet of Example 8 was obtained totally in the same manner as in Example 1 except that the coating liquid for a primer layer 1 was replaced by a coating liquid for a primer layer 8 having the following composition.

<Coating Liquid for Primer Layer 8>

| | |
|---|---|
| Urethane resin (solid content 35%, Ts: 180° C.) (AP-40N, DIC Corporation) | 14.3 parts (solid content 5.01 parts) |
| Water/isopropyl alcohol mixed solvent (1:1) | 85.7 parts |

Example 9

The thermal transfer sheet of Example 9 was obtained totally in the same manner as in Example 1 except that the coating liquid for a primer layer 1 was replaced by a coating liquid for a primer layer 9 having the following composition.

<Coating Liquid for Primer Layer 9>

| | |
|---|---|
| Urethane resin (solid content 22.5%, Ts: 110° C.) (AP-40F, DIC Corporation) | 22.2 parts (solid content 5 parts) |
| Water/isopropyl alcohol mixed solvent (1:1) | 77.8 parts |

Example 10

The thermal transfer sheet of Example 10 was obtained totally in the same manner as in Example 1 except that the coating liquid for a primer layer 1 was replaced by a coating liquid for a primer layer 10 having the following composition.

<Coating Liquid for Primer Layer 10>

| | |
|---|---|
| Urethane resin (solid content 30%, Ts: 205° C.) (SUPERFLEX 150, DKS Co. Ltd.) | 16.7 parts (solid content 5.01 parts) |
| Water/isopropyl alcohol mixed solvent (1:1) | 83.3 parts |

Example 11

The thermal transfer sheet of Example 11 was obtained totally in the same manner as in Example 1 except that the coating liquid for a primer layer 1 was replaced by a coating liquid for a primer layer 11 having the following composition.

<Coating Liquid for Primer Layer 11>

| | |
|---|---|
| Polyester resin (Tg: 67° C.) (Vylon 200, TOYOBO CO., LTD.) | 5 parts |
| Water/isopropyl alcohol mixed solvent (1:1) | 95 parts |

Example 12

The thermal transfer sheet of Example 12 was obtained totally in the same manner as in Example 1 except that the coating liquid for a primer layer 1 was replaced by a coating liquid for a primer layer 12 having the following composition.

<Coating Liquid for Primer Layer 12>

| | |
|---|---|
| Polyester resin (solid content 25%, Tg: 110° C.) (Plascoat Z-690, DKS Co. Ltd.) | 20 parts (solid content 5 parts) |
| Water/isopropyl alcohol mixed solvent (1:1) | 80 parts |

Example 13

The thermal transfer sheet of Example 13 was obtained totally in the same manner as in Example 1 except that the coating liquid for a primer layer 1 was replaced by a coating liquid for a primer layer 13 having the following composition.

<Coating Liquid for Primer Layer 13>

| | |
|---|---|
| Polyvinyl alcohol resin (KURARAY POVAL PVA-117, KURARAY CO., LTD.) | 3 parts |
| Isocyanate (DURANATE WB40-100, Asahi Kasei Chemicals Corporation) | 2 parts |
| Water | 95 parts |

Example 14

The thermal transfer sheet of Example 14 was obtained totally in the same manner as in Example 1 except that the coating liquid for a primer layer 1 was replaced by a coating liquid for a primer layer 14 having the following composition.

<Coating Liquid for Primer Layer 14>

| | |
|---|---|
| Polyvinyl alcohol resin (KURARAY POVAL PVA-117, KURARAY CO., LTD.) | 2.6 parts |

-continued

| | |
|---|---|
| Ti chelating agent (solid content 44%) (ORGATIX TC-310, Matsumoto Fine Chemical Co., Ltd.) | 5.6 parts (solid content 2.46 parts) |
| Water | 91.8 parts |

Example 15

The thermal transfer sheet of Example 15 was obtained totally in the same manner as in Example 1 except that the coating liquid for a primer layer 1 was replaced by a coating liquid for a primer layer 15 having the following composition.

<Coating Liquid for Primer Layer 15>

| | |
|---|---|
| Acryl polyol (solid content 50%, Tg: 49° C.) (A-801, DIC Corporation) | 7.5 parts (solid content 3.75 parts) |
| Isocyanate (solid content 75%) (D-110N, Mitsui Chemicals, Inc.) | 2.4 parts (solid content 1.8 parts) |
| Methyl ethyl ketone | 90.1 parts |

Comparative Example 1

The thermal transfer sheet of Comparative Example 1 was obtained totally in the same manner as in Example 1 except that the coating liquid for a primer layer 1 was replaced by a coating liquid for a primer layer A having the following composition.

<Coating Liquid for Primer Layer A>

| | |
|---|---|
| Urethane resin (solid content 30%, Ts: 90° C.) (AP-20, DIC Corporation) | 16.7 parts (solid content 5.01 parts) |
| Water/isopropyl alcohol mixed solvent (1:1) | 83.3 parts |

Comparative Example 2

The thermal transfer sheet of Comparative Example 2 was obtained totally in the same manner as in Example 1 except that the coating liquid for a primer layer 1 was replaced by a coating liquid for a primer layer B having the following composition.

<Coating Liquid for Primer Layer B>

| | |
|---|---|
| Polyester resin (Tg: 47° C.) (Vylon 600, TOYOBO CO., LTD.) | 5 parts |
| Water/isopropyl alcohol mixed solvent (1:1) | 95 parts |

Comparative Example 3

The thermal transfer sheet of Comparative Example 3 was obtained totally in the same manner as in Example 1 except that the coating liquid for a primer layer 1 was replaced by a coating liquid for a primer layer C having the following composition.

<Coating Liquid for a Primer Layer C>

| | |
|---|---|
| Polyester resin (Tg: 4° C.) (Vylon 500, TOYOBO CO., LTD.) | 5 parts |
| Water/isopropyl alcohol mixed solvent (1:1) | 95 parts |

Comparative Example 4

The thermal transfer sheet of Comparative Example 4 was obtained totally in the same manner as in Example 1 except that the coating liquid for a primer layer 1 was replaced by a coating liquid for a primer layer D having the following composition.

<Coating Liquid for a Primer Layer D>

| | |
|---|---|
| Silica particles (non-sol type, non-scale-like) (particle size: 25 μm) (Sylysia 710, Fuji Silysia Chemical Ltd.) | 1 part |
| Polyester resin (Tg: 47° C.) (Vylon 600, TOYOBO CO., LTD.) | 4 parts |
| Methyl ethyl ketone | 95 parts |

Comparative Example 5

The thermal transfer sheet of Comparative Example 5 was obtained totally in the same manner as in Example 1 except that the coating liquid for a primer layer 1 was replaced by a coating liquid for a primer layer E having the following composition.

<Coating Liquid for a Primer Layer E>

| | |
|---|---|
| Acryl type filler (particle size: 20 μm) (HB-2051, SEKISUI CHEMICAL CO., LTD.) | 1 part |
| Polyester resin (Tg: 47° C.) (Vylon 600, TOYOBO CO., LTD.) | 4 parts |
| Methyl ethyl ketone | 95 parts |

Comparative Example 6

The thermal transfer sheet of Comparative Example 6 was obtained totally in the same manner as in Example 1 except that the coating liquid for a primer layer 1 was replaced by a coating liquid for a primer layer F having the following composition.

<Coating Liquid for a Primer Layer F>

| | |
|---|---|
| Acryl polyol (solid content 50%, Tg: 20° C.) (A-811-BE, DIC Corporation) | 9 parts (solid content 4.5 parts) |
| Isocyanate (solid content 75%) (D-110N, Mitsui Chemicals, Inc.) | 1 part (solid content 0.75 parts) |
| Methyl ethyl ketone | 90 parts |

Comparative Example 7

The thermal transfer sheet of Comparative Example 7 was obtained totally in the same manner as in Example 1 except that the coating liquid for a primer layer 1 was replaced by a coating liquid for a primer layer G having the following composition.

<Coating Liquid for Primer Layer G>

| | |
|---|---|
| Colloidal silica (solid content 40%) (MP-4540M particle size 420 nm-480 nm, Nissan Chemical Industries, Ltd.) | 14 parts (solid content 5.6 parts) |
| Water/isopropyl alcohol mixed solvent (1:1) | 86 parts |

(Production of Intermediate Transfer Medium)

Using a polyethylene terephthalate film having a thickness of 12 μm (Lumirror manufactured by Toray Industries, Inc.) as the substrate, the substrate was coated with a coating liquid for a peeling layer having the following composition so as to obtain a coating amount of 1.0 g/m$^2$ in a dried state to form a peeling layer. Subsequently, the peeling layer was coated with a coating liquid for a protective layer having the following composition so as to obtain a coating amount of 4.5 g/m$^2$ in a dried state to form a protective layer. Furthermore, the protective layer was coated with a coating liquid for a receiving layer having the following composition so as to obtain a coating amount of 2.0 g/m$^2$ in a dried state to form a receiving layer to thereby obtain an intermediate transfer medium. Incidentally, all the coating liquid for a peeling layer, the coating liquid for a protective layer, and the coating liquid for a receiving layer were applied by gravure coating.

| <Coating liquid for peeling layer> | |
|---|---|
| Acryl resin (Dianal BR-83, Mitsubishi Rayon Co., Ltd.) | 20 parts |
| Polyester resin (Vylon 600, TOYOBO CO., LTD.) | 1 part |
| Methyl ethyl ketone | 79 parts |
| <Coating liquid for protective layer> | |
| Polyester resin (Vylon GK-250, TOYOBO CO., LTD.) | 20 parts |
| Methyl ethyl ketone | 80 parts |
| <Coating liquid for receiving layer> | |
| Vinyl chloride-vinyl acetate copolymer resin (SOLBIN CNL, Nissin Chemical Industry Co., Ltd.) | 20 parts |
| Silicone oil (X-22-3000T, Shin-Etsu Chemical Co., Ltd.) | 1 part |
| Methyl ethyl ketone | 79 parts |

<Peel-off Property Test>

A sublimation-transfer photograph-like image was formed on the receiving layer of the intermediate transfer medium produced above. Then, the receiving layer of the intermediate transfer medium on which the thermally transferable image had been formed and the peel-off layer of the thermal transfer sheet of each of Examples and Comparative Example produced above were superposed on each other so as to become in contact with each other. The side of the back face of the thermal transfer sheet was heated by using the following printer to remove a portion of the region of the transfer layer constituted by the peeling layer/protective layer/receiving layer from the intermediate transfer medium. Meanwhile, occurrence of reverse transfer of the peel-off layer was visually observed, and the peel-off property was evaluated based on the following evaluation criteria. Evaluation results are shown in Table 1. Incidentally, in this evaluation, in addition to an evaluation of the peel-off property at an applied voltage of 18 V, an evaluation of the peel-off property at an applied voltage of 21 V was carried out. The evaluation of the peel-off property at an applied voltage of 21 V is an evaluation under severer conditions. That the peel-off property is satisfactory under these conditions indicates that the peel-off property becomes satisfactory under wide peel-off conditions.

(Printer)

Thermal head: KEE-57-12GAN2-STA (manufactured by KYOCERA Corporation)

Heater average resistance: 3303(Ω)

Main scanning direction printing density: 300 dpi

Sub scanning direction printing density: 300 dpi

One line cycle: 2.0 (msec.)

Printing start temperature: 35 (° C.)

Pulse-Duty ratio: 85%

Applied voltage: low energy 18 (V), high energy 21 (V)

"Evaluation Criteria"

○ Peel-off can be carried out without any problem.

Δ Occurrence of reverse transfer is observed partly.

x Reverse transfer is observed almost entirely.

TABLE 1

| | Peel-off property | |
|---|---|---|
| | Applied voltage (18 V) [Low] | Applied voltage (21 V) [High] |
| Example 1 | ○ | ○ |
| Example 2 | ○ | Δ |
| Example 3 | ○ | ○ |
| Example 4 | ○ | Δ |
| Example 5 | ○ | ○ |
| Example 6 | ○ | Δ |
| Example 7 | ○ | Δ |
| Example 8 | ○ | ○ |
| Example 9 | ○ | Δ |
| Example 10 | ○ | Δ |
| Example 11 | ○ | Δ |
| Example 12 | ○ | ○ |
| Example 13 | ○ | ○ |
| Example 14 | ○ | ○ |
| Example 15 | ○ | Δ |
| Comparative Example 1 | x | x |
| Comparative Example 2 | Δ | x |
| Comparative Example 3 | x | x |
| Comparative Example 4 | Δ | x |
| Comparative Example 5 | Δ | x |
| Comparative Example 6 | x | x |
| Comparative Example 7 | x | x |

REFERENCE SIGNS LIST

1 substrate
2 primer layer
4 peel-off layer
5 back face layer
7 dye layer
8 fusible layer
10 thermal transfer sheet
16 heating device
30 intermediate transfer medium
31 transfer layer
A peripheral edge of transfer layer
B area on which an IC chip is to be placed

The invention claimed is:

1. A thermal transfer sheet comprising:

a substrate;

a peel-off layer adapted to remove a transfer layer of an intermediate transfer medium; and a primer layer;

wherein the primer layer and the peel-off layer are provided in this order on the substrate;

wherein the primer layer is formed directly on a surface of the substrate and directly contacts both the substrate and the peel-off layer; and wherein the primer layer contains at least one of alumina derived from sol-based inorganic particles having a primary particle size of 200 nm or less, a polyvinyl pyrrolidone type resin having a glass-transition temperature (Tg) of 150° C. or more, a polyester resin having a glass-transition temperature (Tg) of 100° C. or more, and a resin formed by curing a polyvinyl alcohol type resin.

* * * * *